United States Patent [19]

Ray, Jr. et al.

[11] 4,198,177

[45] Apr. 15, 1980

[54] METHOD AND APPARATUS FOR REPAIR OF ASPHALT SURFACES

[75] Inventors: Louis M. Ray, Jr., Rowlett; George R. Littrell, Jr., Garland; Arliff E. Buckland, Jr., Alto; Gordon D. Brett, Sherman, all of Tex.

[73] Assignee: Collier and Associates, Cleveland, Ohio

[21] Appl. No.: 954,828

[22] Filed: Oct. 26, 1978

[51] Int. Cl.[2] ..... E01C 19/08

[52] U.S. Cl. ..... 404/75; 404/83; 126/19.5; 222/146 R

[58] Field of Search ..... 404/83, 92, 101, 108, 404/111, 75; 126/19.5; 222/146 R, 146 H

[56] References Cited

U.S. PATENT DOCUMENTS

| | | | |
|---|---|---|---|
| Re. 14,587 | 1/1919 | Johnston | 404/111 X |
| 1,674,989 | 6/1928 | Powell | 404/111 X |
| 1,714,659 | 5/1929 | Chausse | 404/111 X |
| 1,927,752 | 9/1933 | Pardee | 404/111 X |
| 2,192,027 | 2/1940 | Crowder | 404/111 |
| 3,217,620 | 11/1965 | Mindrum | 404/108 X |
| 3,260,176 | 7/1966 | Bowers | 404/111 |

*Primary Examiner*—Nile C. Byers, Jr.

[57] ABSTRACT

In a system for repairing asphalt surfaces including an emulsion tank, air pressure source, emulsion heating source, pneumatic tools and a vehicle having a fluid cooled engine and a utility body for containing asphalt repairing material, the improvement comprising an emulsion tank removably mounted on said vehicle for containing a water soluable, air cured, sealer-bonding agent, an air compressor mounted on and driven by said vehicle engine, an air storage tank removably mounted on said vehicle and coupled to said compressor and pressurized thereby, means for selectively coupling air from said pressurized tank to said pneumatic tools and said emulsion tank and means coupling said vehicle cooling fluid to said emulsion tank for heating said emulsion to a usable temperature whereby certain of said pneumatic tools may be selectively driven by said compressed air in said storage tank to trim a damaged asphalt surface, spray emulsion over said trimmed are under pressure from said compressed air tank, and compact said asphalt repairing material into said trimmed and sealed area thereby repairing said damaged asphalt area.

18 Claims, 4 Drawing Figures

METHOD AND APPARATUS FOR REPAIR OF ASPHALT SURFACES

BACKGROUND OF THE INVENTION

Extensive use is made of asphalt paving as a means for surfacing for general traffic use, both on primary and secondary roads, as well as parking lots and, in some locations, as sidewalks. Asphalt is a dark brown to black cementitious material in which the predominating constituents are bitumens which occur in nature or are obtained in petroleum processing. The Asphalt Institute considers the term "asphalt" to include asphalt cements, asphalt fluxes, asphalt cutbacks, asphalt emulsions, asphalt road oils, roofing and waterproofing asphalts and all other asphalts and asphalt residuums used in the manufacture of asphalts and asphalt specialties. Such widespread use creates an ongoing demand for repair and preventative maintenance. Over prolonged periods of time, for various reasons, the asphalt surface deteriorates or fails or is otherwise damaged and requires repair. Pavements in need of maintenance or repair can exhibit any or all of the following conditions:

"Raveling" is the progressive separation of aggregate particles in a pavement from the surface downward. Usually, the fine aggregate comes off first and leaves little "pock marks" in the pavement surface. As the process continues, larger and larger particles are broken free, and the pavement soon has the rough and jagged appearance typical of surface erosion. Raveling can result from lack of compaction during construction, construction during wet or cold weather, dirty or disintegrating aggregate, poor mix design, or extrinsic damage to the pavement.

"Shrinkage Cracks" are interconnected cracks forming a series of large blocks, usually with sharp corners or angles. They are caused by volume changes in the asphalt mix, in the base, or in the subgrade. "Alligator Cracks" are interconnected cracks forming a series of small blocks resembling an alligator's skin or chicken-wire. In most cases, alligator cracking is caused by excessive deflection of the surface over unstable subgrade or lower courses of the pavement. The unstable support usually is the result of saturated granular bases or subgrade. The affected areas in most cases are not large; sometimes, however, they will cover entire sections of a pavement, and when this happens, it usually is due to repeated loadings exceeding the load-carrying capacity of the pavement.

"Upheaval" is the localized upward displacement of a pavement due to swelling of the subgrade or some portion of the pavement structure. In colder climates, upheaval is commonly caused by expansion of ice in the lower courses of the pavement or the subgrade. It may also be caused by the swelling effect of moisture on expansive soils.

"Pot Holes" are bowl-shaped holes of various sizes in the pavement, resulting from localized disintegration of the pavement under traffic. Contributory factors can be improper asphalt mix design, insufficient pavement thickness, or poor drainage. Also, pot holes may simply be the result of neglecting other types of pavement distress.

"Grade Depressions" are localized low areas of limited size which may or may not be accompanied by cracking. They may be caused by traffic heavier than that for which the pavement was designed, by settlement of the lower pavement layers, or by poor construction methods.

The major failure of asphalt surfacing results from moisture penetration of the base material. This penetration of moisture is generally caused and/or accelerated by overloading small units of area through numerous repetitive cycles until the asphalt covering disrupts or separates. Once this occurs, of course, moisture seeps into the base material and not only naturally deteriorates the material, but also may freeze and cause separation of large amounts or quantities of material which are reduced to small particles by continued use of the surface thus eventually causing a hole or depressed area commonly called a "pot hole" as set forth earlier.

In order to prevent or minimize this type of damage from occurring, the asphalt surface must be periodically sealed with a seal coat solution that penetrates any separations or disruptions in the asphalt surface thus preventing moisture from entering therein. If, however, the pot hole occurs, the only way to prevent additional damage is to trim and excavate the failed area or pot hole, remove any dust, dirt or excess material, reseal the exposed base to preclude any additional moisture from entering therein and replacing the removed asphalt surface with a cold or hot asphalt mix and tamping, compacting, or rolling the hot or cold mix until it achieves the proper density and elevation with respect to the surrounding asphalt surface.

General repair and maintenance of asphalt paving is usually the responsibility of City, County, State and Federal governmental agencies although numerous private contractors also represent not only themselves but also such governmental agencies and owners of parking lots in shopping centers, apartments, etc., in seal coating asphalt surfaces or repairing damaged such surfaces. The number and size of vehicles and equipment which are needed to repair asphalt surfaces depends, of course, upon the quantity of work to be done; however, even in small jobs with just a few pot holes to repair, the vehicles and equipment generally used include a two-and-a-half ton dump truck with cold mix, a portable air compressor driven by an auxiliary power unit and which is pulled by the dump truck, pneumatic tools such as chisels, hammers, air pressure nozzles, tampers and liquid spraying wands, all of which utilize compressed air generated and stored by the air compressor and its associated tank, a portable, gas-fired emulsion tank or sealing compound solution tank, a one-half ton pickup truck which is used to pull the compressor and miscellaneous hand tools such as brooms, shovels, mops, and the like. In addition, at least one person is required to operate each vehicle and perform the required work. Generally a crew of four individuals are involved in such an asphalt repairing operation.

In general, the entire repair fleet goes to the area having the damaged asphalt surface. The air compressor is driven by an auxiliary power unit and is used to compress air to a usable operating pressure. The gas-fired heat source is started to heat the emulsion liquid in the emulsion tank. The emulsion is a petroleum based liquid that is old and well-known in the art and is used as a sealing-bonding agent to prevent moisture seepage from passing any surface coated with the emulsion. To facilitate its use in a wide variety of applications, in varying climatic conditions and with an extensive range of aggregates, emulsified asphalt is manufactured in several different grades. However, as a general matter, emulsified asphalt is an emulsion of asphalt cement and water that contains a small amount of an emulsifying agent. It is a heterogeneous system containing two normally immiscible phases (asphalt and water) in which the water generally forms the continuous phase of the emulsion, and minute globules of asphalt form the discontinuous phase. Depending on the emulsifying agent, emulsified asphalt may be one of two types: cationic, having electro-positively-charged asphalt globules, or anionic, having electro-negatively-charged asphalt globules.

During the time the emulsion is heating, the crew connects the desired pneumatic tools to the air compressor and trims away the partially failed asphalt surface. For instance, around a pot hole, an area is removed which totally surrounds and is at least one foot from the damaged area and, generally, the trimmed hole would be roughly rectangular in shape. Further, the hole will be to a depth required to remove any damaged or loose materials. In the next step, an air nozzle is connected to the air compressor and high pressure air is used to remove all excess soil and material from the repaired area.

Next the cleaned, prepared area is coated with a light application of a tack coat, an emulsified asphalt diluted with water and otherwise known as the emulsion. It is used to ensure a bond between the surface being repaired and the overlying course of asphalt which consists of mineral aggregate bonded together with the emulsified asphalt. As stated earlier, there are many different types of emulsified asphalts, and presently there are sixteen different grades each designed for a specific use. The repaired area is then filled with a dense-graded asphalt mix which may be either hot mix or cold mix but is generally cold mix for small jobs. The cold mix asphalt consists of mineral aggregate uniformly coated with emulsified asphalt and is old and well-known in the art.

The cold mix asphalt is then shoveled into the hole to be repaired and a pneumatic tamping or compacting tool is attached to the pressurized air source and used to tamp or compact the asphalt tightly into place. If the hole is more than six inches deep, each layer of asphalt applied to the hole is compacted thoroughly so that the cold mix and emulsion are firmly bonded. The hole is built up to grade by the addition of the subsequent emulsion, asphalt layers with enough berm added so that settling and road action will eventually blend the patch with the surrounding asphalt. At this time, the repair crew moves to the next location and the procedure is repeated.

It is readily apparent that the investment in personnel, vehicles and equipment is high relative to the amount of actual work needed to be performed. In addition, much of the equipment is specifically designed to accomplish one job only. For example, the air compressor which is towed by one of the vehicles is simply used to provide compressed air and has no other function. The same thing is true for the emulsion tank and the vehicles where the vehicles usually carry the tools and cold mix and, of course, they tow the emulsion tank and the air compressor. It is obvious, then, that the equipment and personnel required to patch asphalt paving as set forth above involves such expense as to preclude a small business owner such as an apartment owner or shopping center owner from operating and maintaining his own equipment for such asphalt repairs.

The advantage, of course, of using multiple vehicles and separately towed emulsion tanks and air compressors is that the towed items can be unhooked from the vehicles when the job is completed and the vehicle can be used for other functions.

SUMMARY OF THE INVENTION

Since many requirements for patching and preventative maintenance are small jobs which require short periods of time to complete the maintenance, the present invention is uniquely designed as a module of readily detachable equipment that will fit on a relatively small vehicle such as a one-half ton to one ton utility pickup or other similar vehicle which will allow multiple use of the vehicle inasmuch as when the patching or maintenance job is completed the module may be removed and the vehicle used in other areas of service. The module is simple in construction, low in cost and designed for ease of operation and may be mounted or demounted in less than 30 minutes and may be operated by one person who can accomplish the same task as was performed by the personnel and equipment listed previously. Since this low cost module can be easily mounted on the utility body of a small pick-up truck, small business owners who usually own such a relatively inexpensive general purpose truck, can afford to own a module for use on such truck and thus do their own patching of their asphalt covered parking areas.

Thus, the invention relates to a system for repairing asphalt surfaces including vehicles for transporting a compressor and a gas-fired emulsion tank and carrying cold mix asphalt and pneumatic tools and is an improvement comprising a single vehicle having a fluid cooled engine and a utility body for containing cold mix asphalt, a tank removably attached to the vehicle for storing a liquid used in asphalt applications and repair, an air compressor driven by the vehicle engine, an air storage tank removably attached to the vehicle and coupled by conduits to and pressurized by the air compressor, means for selectively coupling the pneumatic tools to the air storage tank and means coupling the vehicle cooling fluid to the liquid storage tank in a heat transfer relationship for heating the liquid in the storage tank to a usable temperature whereby pneumatic tools such as chisels, hammers, tampers and air nozzle assemblies may be used to prepare an asphalt surface for repair and apply the stored liquid thereto for effecting a specific purpose.

The invention also relates to a portable module for removable attachment to a vehicle used to repair asphalt surfaces, the vehicle having an air compressor with supply conduits and a fluid cooled propulsion means, the module comprising a frame for removable attachment to the vehicle utility body, a first tank attached to the frame for storing pressurized air, means removably coupling the first tank to the vehicle air compressor for receiving pressurized air therefrom, a second tank attached to said frame for receiving a liquid for use in asphalt applications, first means removably coupling the second tank to the cooling fluid with supply conduits for heating the liquid used for asphalt applications, second means coupling pressurized air from the first tank to the second tank to pressurize the second tank and means for enabling selectively coupling of pneumatic tools such as chisels, hammers, air pressure nozzles, compactors and liquid spraying wands to the first and second tanks for preparing an asphalt surface for repair and applying the asphalt liquid thereto for effecting a specific purpose.

Finally, the invention relates to a method of preparing asphalt surfaces comprising the steps of providing a vehicle having a propulsion means, an air compressor driven by the propulsion means, a utility body for containing asphalt paving material and pneumatic tools such as chisels, hammers, air pressure nozzles, tampers and liquid spraying wands for repair of an asphalt surface, removably attaching an asphalt repair module frame to the vehicle, the module comprising a first tank attached to the frame for storing pressurized air, means removably coupling the first tank to the compressor for receiving pressurized air therefrom, a second tank attached to the frame for receiving a liquid for use in asphalt applications, heating means attached to the second tank in heat transfer relationship with the liquid used for asphalt applications, means coupling pressurized air from the first tank to the second tank to pressurize the second tank and selectively attaching the pneumatic tools to the first and second tanks for shaping, cleaning, sealing and patching an asphalt surface whereby one person may transport and use the materials necessary to repair an asphalt surface.

BRIEF DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Although the present invention may be used to repair relatively large areas of the damaged asphalt surfaces set forth previously as well as to apply a thin emulsified asphalt surface treatment known as seal coating to large areas of asphalt surfaces to waterproof and improve the texture of the wearing surface, the preferred embodiment herein is especially useful for patching "pot holes" as will be discussed hereafter.

Figure 1:
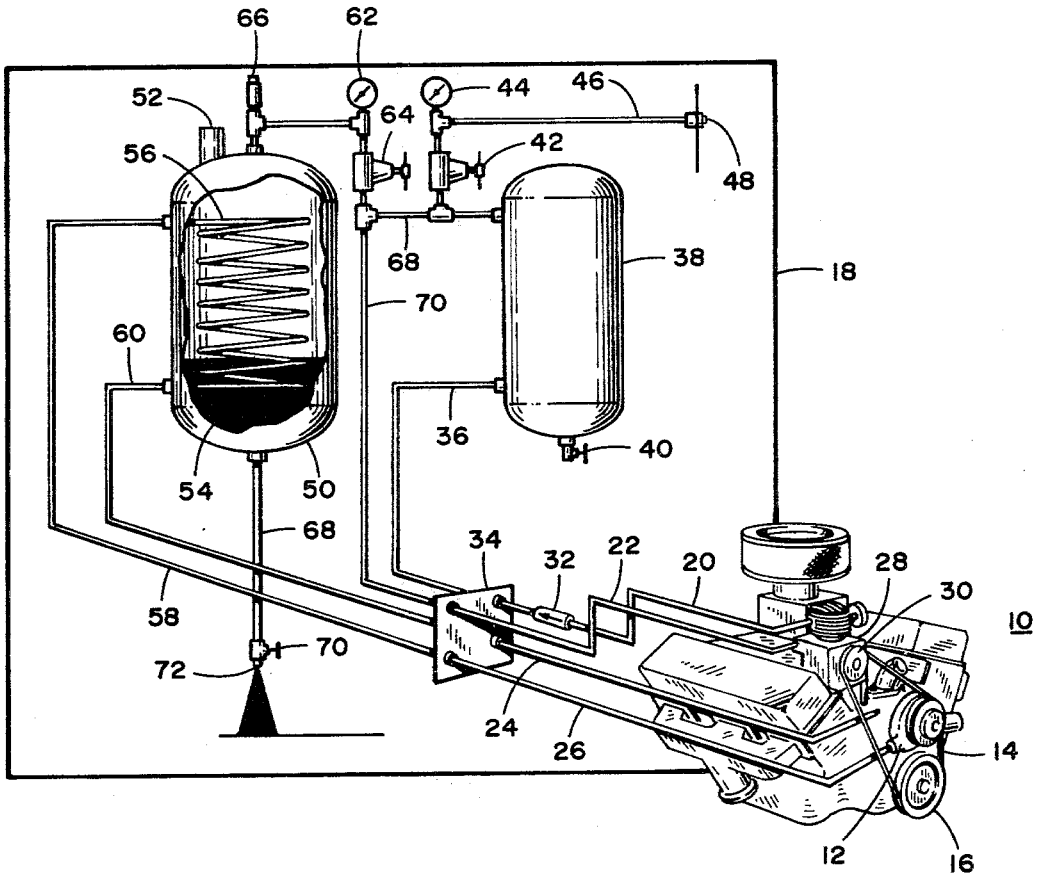
FIG. 1 is a schematic view of the entire system illustrating the manner in which the air pressure tank receives air from the compressor on the vehicle engine and how the emulsion tank is constructed to utilize the cooling fluid from the vehicle engine to heat the emulsion to the desired temperature.

FIG. 1 is a schematic representation of the novel invention and the manner in which it is coupled to a vehicle engine to utilize the services of the existing engine without the requirement of additional equipment. In FIG. 1, the vehicle engine, generally designated by the numeral 10, is any standard type fluid cooled engine having a fluid pump 12 which is driven by a fanbelt 14 attached to drive shaft pulley 16. The fluid pump 12, of course, force circulates the fluid through the engine for purposes of cooling. Obviously, the "fluid" for cooling the engine in this case is water or a water based antifreeze chemical. However, the "fluid" could also include steam or the like if the invention were used with a steam engine. Thus, any heat producing fluid generated in the normal operation of an engine or propulsion device may be coupled through conduits for heating purposes as to be discussed hereafter. The preferred embodiment, however, utilizes water as the heat producing fluid. The water which is heated by the engine and cooled by the radiator, not shown, is also circulated through the vehicle heater system for purposes of heating the interior of the vehicle cab. The temperature in the cab is maintained by a control within the cab (not shown) which regulates the amount of hot water circulating through the heater coils. The elements located within the border defined by the numeral 18 are part of the portable module shown in FIG. 3 and are mounted on the module at the back of the vehicle and are coupled to the vehicle engine 10 by means of conduits 20, 22, 24 and 26. Compressor 28 may be any of the well-known air compressors which may be mounted on and driven by a propulsion means such as engine 10 and which is complete with an integral governor and air filter. In FIG. 1, fanbelt 14 which is driven by driveshaft pulley 16 also passes over compressor pulley 30 to drive the compressor.

The output of the compressor is coupled through conduit 20 to a one way check valve 32 and thence to quick disconnect panel 34. As will be explained hereinafter, quick disconnect panel 34 is mounted on the vehicle body near the back of the vehicle near that part of the vehicle where the portable module is to be mounted and the hoses from the module can be easily and quickly connected to quick disconnect panel 34. The pressurized air passes through quick disconnect panel 34 to conduit 36 which is coupled to air pressure tank 38. The tank 38 includes a bleed valve 40, a regulator or control valve 42 and a pressure guage 44. Conduit 46 couples the air pressure to a quick disconnect 48 to which any pneumatic tools may be connected for operation. Control valve 42 adjusts the amount of pressure which is applied to the pneumatic tool and pressure gauge 44 provides the operator an indication of how much pressure is being applied to the tool in use.

The emulsion tank 50 has a filler cap 52 through which the liquid emulsion 54 may be transferred into the container 50. Inside of the emulsion tank 50 is a coiled conduit 56 made for example of copper which is immersed in the emulsion 54 in heat transfer relationship thereto. Conduit 26 receives hot water from the pressure side of water pump in any convenient place but in the preferred embodiment it is taken from a "T" connection placed in the pressure line to the hot water heater of the vehicle. Conduit 26 is coupled to quick disconnect panel 34 and the input conduit 58 of emulsion tank 50 is connected to the other side of quick disconnect panel 34. Thus the hot water from the vehicle engine circulates through pressure conduit 26, through quick disconnect panel 34, conduit 58, the input of emulsion tank 50 and through the conduit coil 56 inside the emulsion tank wherein the hot water transfers its heat to the emulsion 54 thus raising its temperature. The return conduit 60 returns the coolant back to quick disconnect panel 34 and conduit 24 to the return side of the coolant supply for the vehicle engine 10. While FIG. 1 is simply a schematic diagram of the system, it does not illustrate all of the system details well within the skill of the art to implement this invention; however, it will be understood that conduits 24 and 26 for transporting the hot water and the hot water return could be coupled by means of a "T" connection to the input and return hot water lines to the vehicle's heater whereby the controls in the vehicle cab for regulating the heater or cab temperature would also be used to regulate the temperature of the water being used to heat the emulsion 54 in tank 50. The output of air pressure tank 38 on line 68 is not only coupled via conduit 70 back to quick disconnect panel 34 and returned to the compressor, but it is also connected through control valve 64 to a pressure gauge 62 whereby the pressure in emulsion tank 50 may be regulated by control valve 64. Emulsion tank 50 also has a safety valve 66 which is set to open at a predetermined pressure in order to prevent over-pressurization of the tank 50. Emulsion tank 50 has an outlet conduit 68 to which is coupled a shut-off valve 70. A quick disconnect nozzle 72 is coupled to shut-off valve 70 and the spraying wand may be quickly attached to the outlet conduit 68 by use of quick disconnect 72.

While the above-described manner of utilizing the cooling liquid from the vehicle engine cooling system to heat the contents of the emulsion tank forms the preferred embodiment of the present system, it should be understood that the emulsion could be heated in several other ways as, for instance, by a fuel-fired source such as butane, propane or other gas which may be ignited and the fire produced thereby controlled in a heat transfer relationship with said emulsion. Such a fuel-fired source of heat could be located in and confined to a cylindrical tube formed in or attached to the base of the emulsion tank in heat transfer relationship thereto. Such other means for heating the emulsion are contemplated by this invention so long as the emulsion tank and its heating source are portable and removably attached to the single vehicle used in the present invention to patch asphalt surfaces.

Thus, reviewing the operation of the system, various conventional pneumatic tools such as chisels, hammers, compactors, and air nozzle assemblies may be connected to quick disconnect 48 to receive high pressure air from pressure tank 38. With the use of a pneumatic hammer, the outline of the area to be patched is cut and the cut extends at least one foot outside of the distressed area. The outline should be square or rectangular with two of the sides at right angles to the direction of traffic. As much of the pavement is excavated as is necessary to reach firm support. If a patch is to be an integral part of the pavement, its foundation must be as strong or stronger than that of the original roadway. This may mean that some of the subgrade will also have to be removed. The faces of the excavation should be straight and vertical. After the distressed material has been removed to the proper depth, an air nozzle assembly may be attached with quick disconnect 48 and used to further clean the area to be repaired by blowing away all loose dust and particles. Next, a spraying wand is attached to quick disconnect 72 and a tacking coat, a light application of the emulsion, is applied to the vertical faces of the excavation to ensure a bond between the surface being paved and the cold mix asphalt that is to be used to fill the excavation. The cold mix is then shoveled into the excavation and the pneumatic compactor is attached by hoses to quick disconnect 48 and the high pressure air used to operate the compactor to ensure proper compaction of the cold mix. Upon completion of the compaction, the surface of the patch should be at the same elevation as the surrounding pavement. The vehicle can then be moved to the next location for repairing the damaged asphalt or a pot hole.

Figure 2:
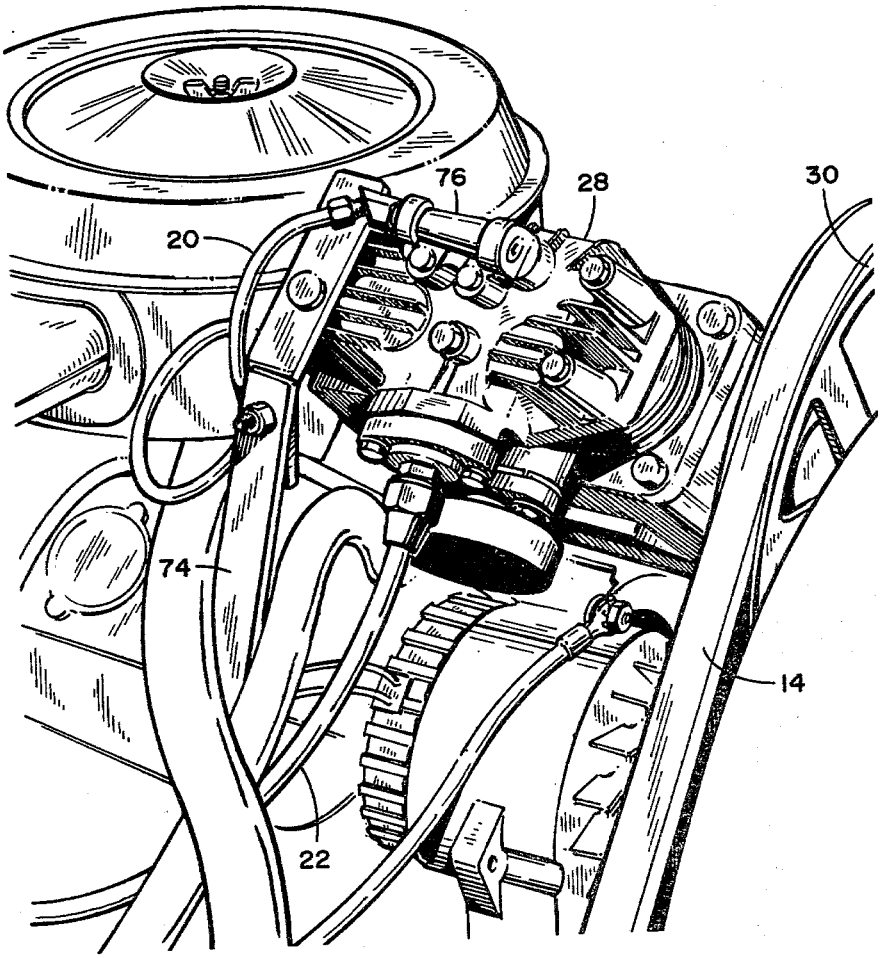
FIG. 2 illustrates the details of the compressor installation on the vehicle engine.

FIG. 2 discloses the details of the air compressor assembly which is mounted to and driven by the vehicle propulsion means. Compressor 28 is attached to the engine block in any convenient location by appropriate mounting brackets 74. Fanbelt 14 which is driven by the engine driveshaft is also coupled to pulley 30 which drives compressor 28. As the air is compressed, it is coupled through line or conduit 22 to quick disconnect panel 34 as shown in FIG. 1. Pressure regulator return line 20 is coupled back from pressure storage tank 38 to pressure control valve 76. Pressure control valve 76 is of the type which can be used to adjust a desired output pressure from the compressor 28 at which time the air compressor is disengaged by a clutch assembly (not shown) to remove the load from the vehicle engine. Thus the air compressor 28 provides a load on the propulsion means of the vehicle only when it is pressurizing the air in tank 38 to the desired pressure. Once that pressure has been reached the clutch assembly (not shown) which is old and well-known in the art disconnects the compressor 28 from drive pulley 30.

Figure 3:
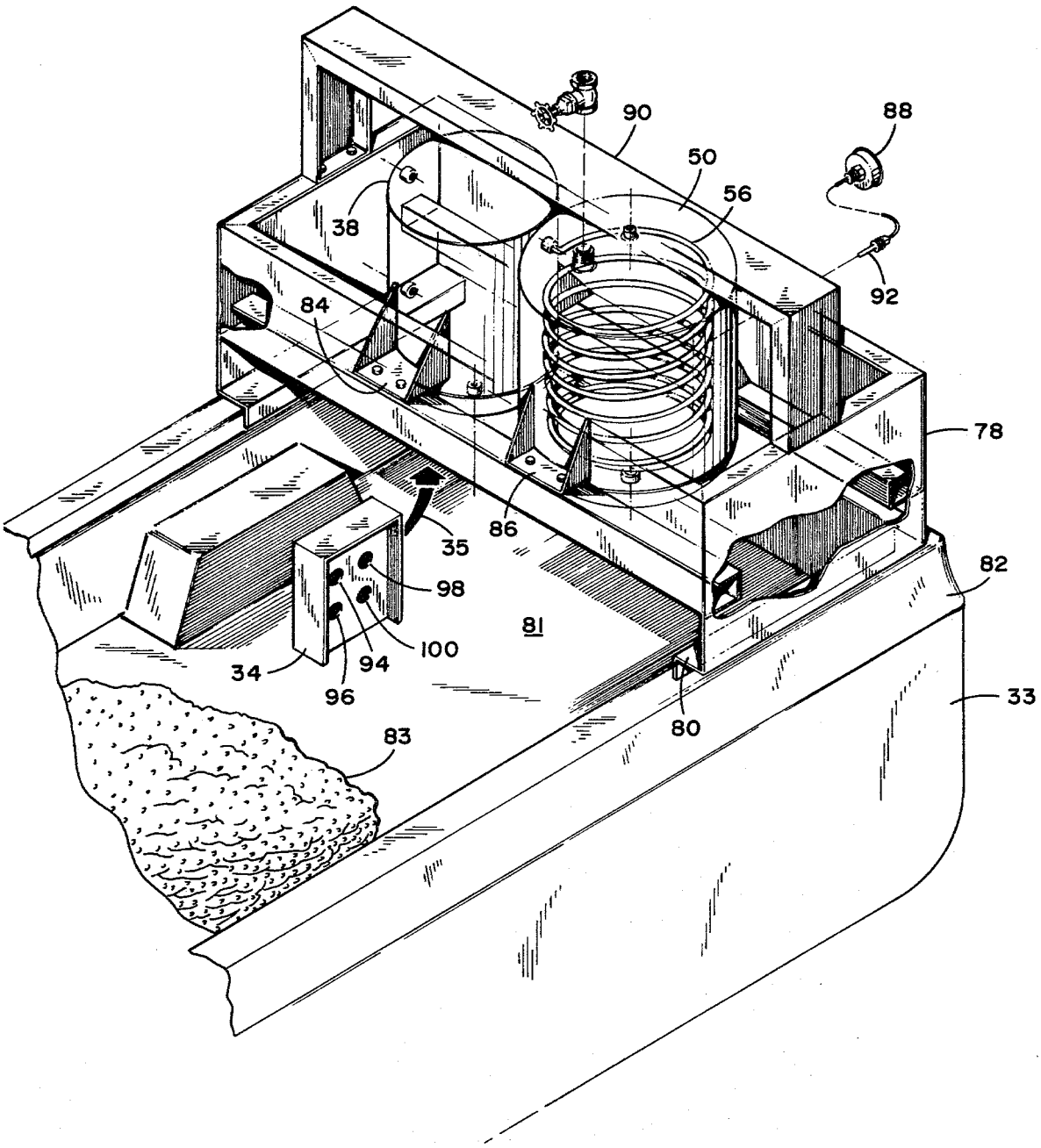
FIG. 3 is a diagrammatic illustration of the portable module which may be removably attached to the side walls of a vehicle utility body.

FIG. 3 is a diagrammatic illustration of the portable, low cost module which may be removably attached to the side walls 82 of a vehicle utility body 33. The module comprises a frame 78 which has a U-shaped base 80 that is properly dimensioned and shaped to fit over the side walls 82 of a vehicle utility body 33. The U-shaped module base 80 allows the operator of the vehicle to easily shovel, dump or otherwise remove the patching material 83, either hot mix or cold mix, from the pickup bed or box 81 by going under U-shaped module base 80. Mounted on said frame 78 is air pressure storage tank 38 and emulsion tank 50. Heating coils 56 are shown within tank 50 for receiving the cooling liquid from the vehicle propulsion means in order to heat the emulsion within tank 50. It will be seen that the conduit 56 is in heat transfer relationship with any material in tank 50. Air pressure tank 38 and emulsion tank 50 are secured to frame 78 by means of brackets 84 and 86 which are bolted to frame 78. A temperature gauge 88 is mounted on the face of vertical panel 90 with a thermocouple 92 being connected to and protruding within tank 50 in order to give a visual indication of the temperature of the emulsion therein.

Quick disconnect box 34 is located under frame 78 in the corner of the vehicle utility body 33 as illustrated by arrow 35. Quick disconnect units are mounted within orifices 94, 96, 98 and 100. Since quick disconnect junction box 34 is permanently mounted in the corner of the vehicle utility body 33, the two lines from the air compressor are permanently connected into one side of the quick disconnects at orifices 94 and 96 while the two conduits from the vehicle cooling system are permanently connected to one side of the quick disconnects at orifices 98 and 100. Thus, when frame 78 is mounted on the vehicle box 82, the two conduits from the air pressure tank 38 shown in FIG. 1, that is conduits 36 and 70, are simply connected to the quick disconnects in orifices 94 and 96 and the two conduits 58 and 60 from emulsion tank 50 are connected to the quick disconnects installed in orifices 98 and 100. When it is desired to remove the module, all of these hoses or conduits are disconnected and the entire module is removed from the vehicle simply by lifting frame 78 off the vehicle body 82. The size and capacity of the compressed air tank and the emulsion tank may vary as needed.

Figure 4:
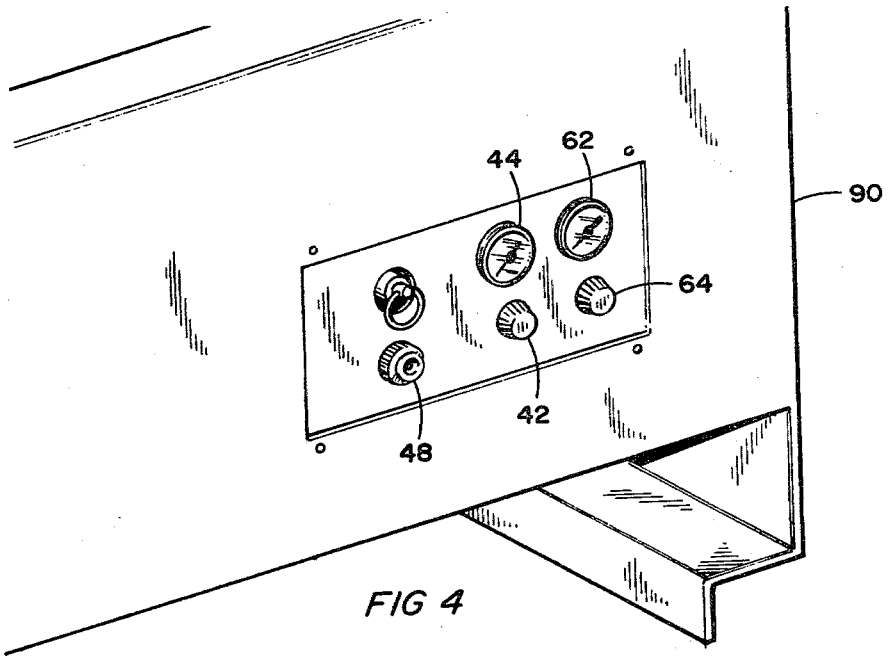
FIG. 4 is a front view of the portable module illustrating the details of the control panel.

FIG. 4 is a partial front view of the portable module illustrating the details of a control panel mounted thereon. Air pressure gauge 44 and air pressure control valve 42 are both mounted on the control panel in order to have easy access by the operator. Thus, the operator can set the desired air pressure simply by watching air pressure gauge 44 while control valve 42 is being adjusted. In like manner, while watching pressure gauge 62 and adjusting control valve 64, the operator can control the amount of air pressure in emulsion tank 50. Also mounted on vertical panel 90 is quick disconnect 48 which is connected to the air pressure tank 38 shown in FIG. 1. Thus when it is desired to utilize any particular pneumatic tool, the conduit coupled to that pneumatic tool is simply attached with quick disconnect 48 and the pressure applied thereto may be adjusted by control valve 42 to the proper value.

FIG. 4 also illustrates the manner in which the frame 78 is shaped at base 80 to fit over the side walls 82 of vehicle utility body 33 for portable mounting thereto. Frame 78 may be securely attached to side walls 82 in any well-known means such as by bolts or braces, not shown.

Thus, there has been disclosed a technical achievement including a unique, portable, modular assembly for removable attachment to a vehicle which forms a self-contained system that will allow as few as one person to repair or patch asphalt surfaces and has in the self-contained sysem all the materials and equipment necessary to repair an asphalt surface including a pressurized source of air, a tank of heated emulsion which is also under pressure as desired for spraying on an asphalt surface, cold mix for patching the asphalt surface and the necessary pneumatic tools and equipment such as brushes, shovels and the like, all of which are carried by the single vehicle. After the patching or maintenance is completed, the portable module may be removed from the vehicle in order that the vehicle may be used in other areas of maintenance or service.

Thus, by utilizing a compressor mounted on and driven by the vehicle engine, a separately pulled compressor and auxiliary power unit is eliminated. By utilizing the cooling liquid of the vehicle's water cooled engine, a separately pulled emulsion tank and heating source is eliminated. By mounting on the vehicle utility body a portable module containing the air pressure storage tank and emulsion tank with flexible quick disconnect hoses and a quick disconnect junction box to couple the compressed air storage tank and the emulsion tank heating coils to the vehicle air compressor and cooling system, respectfully, the system is easily operated and controlled by a single individual, is economical and inexpensive to own and enables a general purpose vehicle to be adapted to this specialized use of asphalt patching and then returned to other service or use by simply disconnecting the hoses and removing the module. Thus, the asphalt repairs themselves become relatively economical and low in cost.

It will also be understood that wherever the term "asphalt surface" is used herein, it will also apply to any other surface such as concrete and the like which can be repaired and maintained with the asphalt patching materials described herein.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. In apparatus for repair of asphalt surfaces including vehicles for pulling a compressor and a gas-fired emulsion tank and carrying cold mix asphalt and pneumatic tools, the improvement comprising:

a. a single vehicle having a propulsion means and a container for receiving cold mix asphalt,
b. an emulsion tank removably attached to said vehicle for storing a liquid used in asphalt applications,
c. an air compressor mounted on said vehicle and driven by said vehicle propulsion means,
d. means coupled to said emulsion tank for heating said emulsion to a usable temperature,
e. an air storage tank removably attached to said vehicle and coupled by conduits to and pressurized by said air compressor, and
f. means selectively coupling said pneumatic tools to said air storage tank whereby pneumatic tools such as chisels, hammers, compactors and air nozzles may be used to prepare an asphalt surface for repair and emulsion may be applied thereto for effecting a specific purpose.

2. Apparatus as in claim 1 wherein said propulsion means includes a fluid cooled engine.

3. Apparatus as in claim 2 wherein said emulsion heating means includes:

a. fluid receiving coils in said emulsion tank in heat transfer relationship with said emulsion, and
b. conduit means coupling said engine cooling fluid to said fluid receiving coils for heating said emulsion.

4. Apparatus as in claim 3 wherein said vehicle is a one-ton pickup having side walls forming a utility body for containing materials.

5. Apparatus as in claim 4 wherein said container for receiving said cold mix asphalt includes said pickup utility body.

6. Apparatus as in claim 5 further including:

a. a portable frame adapted to be removably attached to the walls of said pickup utility body, and
b. means for mounting said emulsion tank and said air pressure tank on said frame.

7. Apparatus as in claim 6 further including quick disconnects for coupling said emulsion tank to said engine cooling fluid conduit means and said air pressure tank to said air compressor conduits.

8. Apparatus as in claim 1 wherein said emulsion heating means includes a fuel-fired heating source attached to said emulsion tank in heat transfer relationship with said emulsion.

9. In apparatus for repair of asphalt surfaces including vehicles for pulling a compressor and a gas-fired emulsion tank and carrying cold mix asphalt and pneumatic tools, the improvement comprising:

a. a single vehicle having a fluid cooled engine and a utility body for containing said cold mix asphalt,
b. a tank removably attached to said vehicle for storing a liquid used in asphalt applications,
c. an air compressor mounted on and driven by said vehicle engine,
d. means coupling said vehicle cooling fluid to said liquid storage tank for heating said liquid to a usable temperature,
e. an air storage tank removably attached to said vehicle and coupled by conduits to and pressurized by said air compressor, and
f. means for enabling selective coupling of said pneumatic tools and said liquid storage tank to said air storage tank whereby selected ones of said pneumatic tools may be used to trim said pot hole area, heated liquid may be sprayed over said trimmed area under pressure from said compressed air tank and certain other pneumatic tools may be used to compact said cold mix into said trimmed and sealed area thereby patching said asphalt surface.

10. A portable module for removable attachment to a vehicle used to repair asphalt surfaces, said vehicle having an air compressor with supply conduits and a fluid cooled propulsion means with supply conduits for said cooling fluid, said module comprising:

a. a frame for removable attachment to said vehicle body, b. a first tank attached to said frame for storing pressurized air, c. means removably coupling said first tank to said compressor for receiving pressurized air therefrom, d. a second tank attached to said frame for receiving a liquid for use in asphalt applications, e. first means removably coupling said second tank to said cooling fluid with supply conduits for heating said liquid used for asphalt applications, f. second means coupling pressurized air from said first tank to said second tank to pressurize said second tank, and g. means for enabling selective coupling of pneumatic tools such as chisels, hammers, air pressure nozzles, compactors and liquid spraying wands to said first and second tanks for preparing an asphalt surface for repair and applying said asphalt liquid thereto for effecting a specific purpose.

11. A portable module as in claim 10 wherein each of said removable coupling means comprises conduits having quick disconnects.

12. A portable module as in claim 10 wherein said second tank further comprises cooling liquid receiving coils in said second tank in heat transfer relationship with said stored liquid therein.

13. A method of repairing asphalt surfaces comprising the steps of:

a. providing a single vehicle having a propulsion means, an air compressor mounted on and driven by said propulsion means, a utility body for containing asphalt paving material and pneumatic tools such as chisels, hammers, air pressure nozzles, compactors and liquid spraying wands for repair of asphalt surfaces, b. removably attaching an asphalt repair module frame to said vehicle, said module comprising:

(i) a first tank attached to said frame for storing pressurized air, (ii) means removably coupling said first tank to said compressor for receiving pressurized air therefrom, (iii) a second tank attached to said frame for receiving a liquid for use in asphalt applications, (iv) heating means attached to said second tank in heat transfer relationship with said liquid used for asphalt applications, (v) means coupling pressurized air from said first tank to said second tank to pressurize said second tank, and c. selectively attaching said pneumatic tools to said first and second tanks for utilizing said compressed air and said liquid in said tanks to shape, clean, seal and patch an asphalt surface whereby one person may transport and use the materials necessary to repair said asphalt surface.

14. A method as in claim 13 including the additional steps of:

a. including a liquid cooled vehicle propulsion means, and b. connecting the heated liquid from said vehicle cooling system in heat transfer relationship to said liquid stored in said second tank for heating said stored liquid to a usable temperature.

15. A method as in claim 14 including the further step of circulating said propulsion means cooling liquid through conduits immersed in said liquid stored in said second tank in heat transfer relationship thereto.

16. A method as in claim 15 further including the step of providing quick disconnects on all conduits leading from said module to said vehicle whereby said module may be quickly and easily removed from said vehicle.

17. A method as in claim 15 further including the step of filling said second tank with a liquid emulsion used as a sealing-bonding agent in asphalt repair.

18. In apparatus for repairing asphalt surfaces including an emulsion tank, air pressure source, emulsion heating source, pneumatic tools and a vehicle having a fluid cooled engine and a utility body for containing asphalt repairing material, the improvement comprising:

a. an emulsion tank removably mounted on said vehicle for containing a water soluble, air cured, sealer-bonding agent, b. an air compressor mounted on and driven by said vehicle engine, c. means coupling said vehicle cooling fluid to said emulsion tank for heating said emulsion to a usable temperature, d. an air storage tank removably mounted on said vehicle and coupled to said compressor and pressurized thereby, and e. means for selectively coupling air from said pressurized tank to said pneumatic tools and said emulsion tank whereby certain of said pneumatic tools may be selectively driven by said compressed air in said storage tank to trim a damaged asphalt surface, emulsion may be sprayed over said trimmed area under pressure from said compressed air tank, and asphalt repairing material may be compacted into said trimmed and sealed area thereby repairing said damaged asphalt area.

* * * * *